US011828115B1

(12) United States Patent
Thomas et al.

(10) Patent No.: US 11,828,115 B1
(45) Date of Patent: Nov. 28, 2023

(54) SYSTEMS AND APPARATUS FOR INCREASING THE OUTER DIAMETER OF A DOWNHOLE TOOL STRING AND METHODS OF ASSEMBLY AND USE THEREOF

(71) Applicant: SWM International, LLC, Pampa, TX (US)

(72) Inventors: Leslie Alan Thomas, White Deer, TX (US); Dan Salkhai Ang, Keller, TX (US)

(73) Assignee: SWM International, LLC, Pampa, TX (US)

( * ) Notice: Subject to any disclaimer, the term of this patent is extended or adjusted under 35 U.S.C. 154(b) by 0 days.

(21) Appl. No.: 17/860,368

(22) Filed: Jul. 8, 2022

Related U.S. Application Data

(60) Provisional application No. 63/220,637, filed on Jul. 12, 2021.

(51) Int. Cl.
*E21B 17/10* (2006.01)

(52) U.S. Cl.
CPC ..... *E21B 17/1085* (2013.01)

(58) Field of Classification Search
CPC .... E21B 17/10; E21B 17/1078; E21B 17/043; E21B 17/042; E21B 17/04
See application file for complete search history.

(56) References Cited

U.S. PATENT DOCUMENTS 1,605,316 A * 11/1926 Wilson ..... E21B 17/1071 166/241.2
2,210,824 A * 8/1940 Walker, Sr. ..... E21B 10/26 175/413
2,513,621 A * 7/1950 Boice ..... E21B 17/1085 175/325.2
2,546,295 A * 3/1951 Boice ..... E21B 17/1085 175/325.2
2,869,827 A * 1/1959 De ..... E21B 10/003 175/401
3,754,609 A * 8/1973 Garrett ..... E21B 17/042 175/323
3,923,324 A * 12/1975 Cruickshank ..... E21B 17/042 175/325.2
4,549,613 A * 10/1985 Case ..... E21B 17/02 175/325.2
4,658,915 A * 4/1987 Goris ..... E21B 17/043 175/320
4,706,764 A * 11/1987 Hughes ..... E21B 17/1078 175/320
10,167,682 B2 * 1/2019 Morrow ..... E21B 17/042
(Continued)

*Primary Examiner* — Kipp C Wallace
(74) *Attorney, Agent, or Firm* — E. Randall Smith; E. Randall Smith, P.C.

(57) ABSTRACT

Systems, apparatus and methods useful for increasing the outer diameter of a tool string at a desired location in the tool string involve a spacer tool having a mandrel releasably engageable with at least one other tool of the tool string and a gauge ring distinct from and releasably, non-threadably engageable with the mandrel. The gauge ring extends radially outwardly from the mandrel to provide the spacer tool with a maximum outer diameter that is greater than the maximum outer diameter of at least one other tool in the tool string.

23 Claims, 8 Drawing Sheets

(56) References Cited

U.S. PATENT DOCUMENTS

| | | | | |
|---|---|---|---|---|
| 2004/0216866 | A1* | 11/2004 | Barlow | E21B 17/042 166/55 |
| 2005/0183860 | A1* | 8/2005 | Golby | E21B 17/1078 166/242.6 |
| 2017/0247956 | A1* | 8/2017 | Estrada | E21B 17/12 |
| 2021/0301599 | A1* | 9/2021 | Mulhern | E21B 43/119 |
| 2022/0120548 | A1* | 4/2022 | Sullivan | E21B 43/119 |

* cited by examiner

SYSTEMS AND APPARATUS FOR INCREASING THE OUTER DIAMETER OF A DOWNHOLE TOOL STRING AND METHODS OF ASSEMBLY AND USE THEREOF

The present application claims priority to U.S. Provisional Patent Application Ser. No. 63/220,637 filed on Jul. 12, 2021 and entitled "Downhole Gauge-Ring Assembly, Methods of Manufacture, Assembly & Use Thereof", which is hereby incorporated by reference herein in its entirety.

FIELD OF THE DISCLOSURE

The present disclosure relates generally to apparatus and systems for providing increased outer diameter in a downhole tool string and methods of manufacture, assembly and use thereof, and in some embodiments, involves a spacer tool for providing downhole standoff, pump down and/or tool wear-prevention capabilities, other capabilities or a combination thereof.

BACKGROUND

In downhole and similar types of operations, a tool string carrying one or more tools for performing desired downhole tasks or functions is typically employed. In such operations, it is often desirable to selectively increase some portion(s) of the outer diameter or width (collectively, the "OD") of the tool string. Depending upon the situation, this capability may be useful for any variety of reasons, such as, for example, to provide mechanical standoff and/or a hydraulic function (e.g. assist in pump down), help prevent wear to one or more other tools in the tool string due to undesirable contact with the borehole wall or a combination thereof.

Typically, tool string operators should be prepared to accommodate different situations warranting different increases in the OD of the tool string. The need for different sized-outer diameters may be due to the type, characteristic(s), quantity or function of one or more tools in the tool string, the size, orientation or nature of the borehole, changing tasks or conditions in the borehole or a variety of other variables.

Presently, to provide an increased-OD at one or more select locations along a tool string (an OD greater than that of other tools in the tool string), a one-piece component formed with a set OD (the "increased-OD tool") is connected in the tool string at the desired locations. For example, the increased-OD tool may be an integrally formed gauge-ring/sub combination. Consequently, when the increased-OD tool is damaged or worn, or needs to be replaced for some other reason (e.g. changing circumstances in the borehole), the entire tool must be removed from the tool string and replaced. Furthermore, because the increased-OD tool provides only one size OD, the typical operator will need to stock, or have access, to a series of different sized increased-OD tools to accommodate situations requiring differing outer diameters.

Accordingly, there exists a need for improved systems, apparatus and methods useful for providing increased OD in a tool string. Such improved systems, apparatus and methods may, for example, involve a spacer tool have one or more of the attributes or capabilities listed below, as described or shown in other portions of this patent or as may be apparent therefrom: provides the tool string with a larger OD than the OD of one or more other tools (e.g. perforating guns) on the tool string and, in some cases, the entire tool string; provides the tool string with any desired OD (e.g. based upon job requirements); may be easily modified or customized to fit a particular operation or changing circumstances; can be used in any combination of configurations at the forward and/or rear ends of the tool string and/or between other tool string components (e.g. for standoff, pump down, wear protection, etc.); provides one or more surfaces or features against which the tool string may be pumped down into the borehole; spaces the tool string (or components thereof) away from at least one side the borehole wall (e.g. the casing) as desired; provides a desired standoff of one or more other tools (e.g. perforating guns) of the tool string relative to one or more sides of the borehole wall; lifts the tool string (or one or more components thereof) off the bottom the borehole wall in a horizontal or deviated borehole; prevents undesirable tilting of the tool string or one or more components thereof (e.g. perforating guns) in the borehole; can be used to position one or more components of the tool string closer to the center or one or more sides of the borehole wall as desired; includes a mandrel that carries a separate gauge ring and locates it radially and axially; includes a gauge ring easily removable from a mandrel; includes a gauge ring removably coupled to a mandrel without threaded engagement therebetween; includes a gauge ring that slidably engages a mandrel; includes one or more removable, replaceable gauge rings that are slidably engaged with a mandrel into one or more operating positions without threads or mechanical connectors therebetween; includes a gauge ring that can be easily backed off a mandrel for replacement; includes a mandrel that can accommodate different sizes (e.g. OD) or types of gauge rings; includes an easily removable, expendable gauge ring that can be replaced with the same or a different type (e.g. OD size) of gauge ring (e.g. to accommodate changing downhole conditions or objectives, when the gauge ring is worn or damaged) without replacing the associated mandrel or entire spacer tool; can be deployed in any predictable size (e.g. diameter) boreholes by simply changing the gauge ring; involves a gauge ring retained in an operating position by one or more adjacent tool string components; is designed so that one or more adjacent tools on the tool string capture the gauge ring in one direction (axially), avoiding the need for a threadable or other costly, failure-susceptible, time-consuming connection between the gauge ring and associated mandrel; involves the connection of adjacent tool string components (e.g. perforating guns) to its opposite ends and at least one of which shoulders and torques up against the gauge ring, preventing the gauge ring from loosening or disconnecting from the mandrel during operations; ensures proper engagement (application of torque) with adjacent tool string components and positioning of the gauge ring; can provide confirmation of proper torque applied to the threaded connection of one or more adjacent tools thereto when one or more adjacent tools abuts or shoulder up against its gauge ring; rotationally locks the mandrel and gauge ring thereof; includes one or more rotational locks (e.g. corresponding flats on the gauge-ring and mandrel) that rotationally lock the gauge ring with the mandrel, allowing torque to be transmitted between the mandrel and gauge ring without the need for threads or other mechanical connections therebetween; may be a tandem spacer and/or an end spacer; alleviates the need for replacement with an entirely different increased-OD tool due to wear, changing downhole conditions, different OD boreholes, etc.; provides reductions in cost, manpower and effort in the manufacture, inventory and supply management, assembly, use and disposal thereof for providing pump down, standoff, tool wear prevention or other downhole capabilities; is simple, reliable and reusable; optimizes efficiency and speed of tool string deployment and recovery; allows desired fluid flow bypass during deployment and/or retrieval of the tool string to/from the borehole; minimizes the amount of fluid needed to pump the tool string down to desired depth; allows optimal fluid bypass during pump down and/or removal of the tool string from the borehole; includes one or more fluid flow passageways that allow fluid bypass in the borehole to allow rapid removal of the tool string from the borehole; or any combination thereof.

It should be understood that the above-described examples, disadvantages, limitations, features and capabilities are provided for illustrative purposes only and are not intended to limit the scope or subject matter of this disclosure or the appended claims. Thus, none of the appended claims should be limited by the above discussion or construed to address, include or exclude each or any of the above-cited examples, disadvantages, features and capabilities merely because of the mention thereof herein.

BRIEF SUMMARY OF THE DISCLOSURE

In some embodiments, a spacer tool is useful for increasing the outer diameter of a tool string at a desired location in the tool string. The tool string includes at least one other tool, each tool in the tool string having its own maximum outer diameter. The spacer tool includes a mandrel releasably engageable with at least one other tool of the tool string and a gauge ring distinct from and releasably, non-threadably engageable with the mandrel. The gauge ring is at least partially movable over at least part of the mandrel into at least one operating position and extends radially outwardly therefrom to provide the maximum outer diameter of the spacer tool. The maximum outer diameter of the spacer tool is greater than the maximum outer diameter of at least one other tool in the tool string to increase the outer diameter of the tool string at that location.

If desired, the gauge ring may be slidably engageable with the mandrel and the gauge ring and mandrel may not be directly coupled together with threads or any other form of coupling mechanism(s) extending between and coupling the gauge ring directly to the mandrel. The gauge ring may be secured to the mandrel only by a first adjacent tool in the tool string. The first adjacent tool may be threadably engageable with the mandrel, wherein the threaded engagement of only the first adjacent tool to the mandrel secures the gauge ring to the mandrel. The mandrel may include at least one shoulder extending outwardly therefrom so that the gauge ring is in at least one operating position when the gauge ring is sandwiched between the first adjacent tool and at least one shoulder of the mandrel. The first adjacent tool may be threadably engageable with the mandrel so that the proper amount of torque to threadably engage the first adjacent tool and the mandrel is applied when the gauge ring abuts and is sandwiched between the first adjacent tool and at least one shoulder of the mandrel. The gauge ring may have an internal bore and at least a first shoulder extending radially inwardly therein and the mandrel may have an outer surface and at least a first shoulder extending outwardly therefrom so that the gauge ring is in an operating position when at least the first shoulder thereof abuts at least the first shoulder of the mandrel.

If desired, the spacer tool may include at least one rotational lock formed or extending between the gauge ring and mandrel when the gauge ring is in at least one operating position. The gauge ring may have an at least partially cylindrically-shaped bore surrounded at least partially by a wall and at least one flat provided in or on the wall, and the mandrel may have an at least partially cylindrically-shaped outer surface and at least one flat provided in or on the outer surface so that at least one flat of the wall of the bore of the gauge ring aligns over at least one flat of the outer surface of the mandrel when the gauge ring is in an operating position. The mandrel and at least one adjacent tool in the tool string may be threadably engageable and the gauge ring, in at least one operating position, may be rotationally locked to the mandrel so that the gauge ring in an operating position can be gripped to allow threadable engagement and disengagement of the mandrel with the adjacent tool(s) without separately gripping the mandrel with any gripping tools.

The tool string may be deployable into a borehole and at least one outer surface of the mandrel and/or the gauge ring may include at least one chamfer formed at a desired angle. The mandrel and/or gauge ring may include at least one leading edge that is closest to borehole wall when the tool string is moving through the borehole so that at least one chamfer is provided at one or more leading edges of the mandrel and/or gauge ring. At least one chamfer may be shaped and sized to help avoid hang-ups of the tool string when the tool string is moving through the borehole. The gauge ring may include at least one pump-down surface extending radially outwardly therefrom and into the borehole when the tool string is deployed in the borehole. The gauge ring may be sized and shaped so that the maximum outer diameter of the spacer tool spaces at least one adjacent tool away from the borehole wall when the tool string is deployed in the borehole.

The spacer tool may be releasably engageable with the tool located at the forward end of the tool string so that the spacer tool becomes the forwardmost tool in the tool string and serves as an end spacer. The spacer tool may be releasably engageable with and between two other tools in the tool string so that the spacer tool serves as a tandem spacer. A plurality of interchangeable gauge rings may be each separately engageable with the mandrel, each gauge ring having at least one difference in size, shape, configuration or other characteristic than the other gauge rings, whereby the same mandrel can accommodate any among the plurality of gauge rings.

In various embodiments, the present disclosure involves a spacer tool useful for increasing the outer diameter of a perforating gun string having at least a first perforating gun and being deployable in an underground borehole. The spacer tool and first perforating gun each have a respective maximum outer diameter. The spacer tool includes a mandrel threadably engageable with the first perforating gun and a gauge ring distinct from and releasably, non-threadably engageable with the mandrel. Threadable engagement of the first perforating gun to the mandrel prevents the gauge ring from separating from the mandrel. When engaged with the mandrel, the gauge ring extends radially outwardly therefrom to provide the maximum outer diameter of the spacer tool, which is greater than the maximum outer diameter of the first perforating gun. If desired, the mandrel may include at least one protrusion extending outwardly therefrom and the gauge ring may be slidably engageable with the mandrel, so that after the gauge ring is slidably engaged with the mandrel and the first perforating gun is thereafter threadably engaged with the mandrel, the gauge ring is prevented from sliding off the first end of the mandrel by the at least one protrusion and the second end of the mandrel by the first perforating gun.

There are also embodiments that involve a method of increasing the outer diameter of a tool string at a desired location in the tool string with the use of a spacer tool. The spacer tool includes a mandrel and a separate, distinct gauge ring that is non-threadably engageable with the mandrel. The tool string includes at least one other tool adjacent to the spacer tool, each tool in the tool string having its own maximum outer diameter. The method includes sliding the gauge ring at least partially over the mandrel from the first end to the second end of the mandrel. At least one anchor of the gauge ring abuts at least one stop extending outwardly from the mandrel and stops movement of the gauge ring over the mandrel in the direction of the second end thereof. The gauge ring extends radially outwardly from the mandrel to provide the maximum outer diameter of the spacer tool, which is greater than the maximum outer diameter of at least a first adjacent tool on the tool string. The first adjacent tool is secured to the first end of the mandrel and prevents the gauge ring from sliding off the mandrel in the direction of the first end of the mandrel.

In some embodiments, the present disclosure involves a spacer tool useful for increasing the outer diameter of a tool string at a desired location in the tool string. The tool string includes at least one other tool, each tool in the tool string having its own maximum outer diameter. The spacer tool includes at least one mandrel releasably engageable with at least one other tool of the tool string and at least one gauge ring. The gauge ring has upper and lower ends, an interior circumferential shoulder disposed between the upper and lower ends, a bore having a first inner diameter extending from the upper end to the shoulder and a second inner diameter extending from the shoulder to the lower end. The second inner diameter differs from the first inner diameter. The gauge ring is distinct from and releasably, non-threadably engageable with the mandrel and at least partially movable over at least part of the mandrel into at least one operating position and extends radially outwardly therefrom to provide the maximum outer diameter of the spacer tool. The maximum outer diameter of the spacer tool is greater than the maximum outer diameter of the at least one other tool in the tool string to increase the outer diameter of the tool string at that location. Threadable engagement of an outer body of a perforating gun to the mandrel prevents the gauge ring from separating from the mandrel.

In various embodiments, the present disclosure involves a spacer tool useful for increasing the outer diameter of a perforating gun string having at least a first perforating gun and being deployable in an underground borehole. The spacer tool and first perforating gun each have a respective maximum outer diameter. The spacer tool includes a mandrel threadably engageable with the first perforating gun and at least one gauge ring distinct from and releasably, non-threadably engageable with the mandrel. The mandrel has an at least partially cylindrically-shaped outer surface and at least one flat provided in or on the outer surface and facing radially outwardly. When engaged with the mandrel, the gauge ring extends radially outwardly therefrom to provide the maximum outer diameter of the spacer tool that is greater than the maximum outer diameter of the first perforating gun. The gauge ring has a bore surrounded at least partially by a wall and at least one flat provided in or on the wall and facing radially inwardly. At least one flat of the gauge ring can be aligned over at least one flat of the mandrel and alone rotationally locks the gauge ring and mandrel at least during deployment of the tool string into the borehole and operation of the first perforating gun therein. Threadable engagement of the first perforating gun to the mandrel prevents the gauge ring from separating from the mandrel.

In certain embodiments, the present disclosure involves methods of increasing the outer diameter of a tool string at a desired location in the tool string with the use of a spacer tool. The spacer tool includes a mandrel and a separate, distinct gauge ring having a length and a bore surrounded at least partially by an inner wall and being non-threadably engageable with the mandrel. The mandrel has first and second ends and the tool string includes at least a first other tool adjacent to the spacer tool. Each tool in the tool string has its own maximum outer diameter. These methods include sliding the gauge ring at least partially over the mandrel from the first end toward the second end thereof so that a first portion of the gauge ring extends over a first portion of the mandrel and a second portion of the gauge ring extends over a second portion of the mandrel. The first portion of the gauge ring has an inner diameter greater than an inner diameter of the second portion thereof and the first portion of the mandrel has an outer diameter greater than an outer diameter of the second portion thereof. An interior shoulder disposed between the first and second portions of the gauge ring abuts an exterior shoulder disposed between the first and second portions of the mandrel and stops the movement of the gauge ring over the mandrel in the direction of the second end thereof. At least one radially inwardly facing flat provided in or on the inner wall of gauge ring aligns over at least one radially outwardly facing flat provided in or on an outer surface of the mandrel and prevents relative rotation between the gauge ring and mandrel. The gauge ring extends radially outwardly from the mandrel to provide the maximum outer diameter of the spacer tool, wherein the maximum outer diameter of the spacer tool is greater than the maximum outer diameter of the first adjacent tool on the tool string.

Accordingly, the present disclosure includes features and advantages which are believed to enable it to advance tool string technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PRESENTLY PREFERRED EMBODIMENTS

Figure 1:
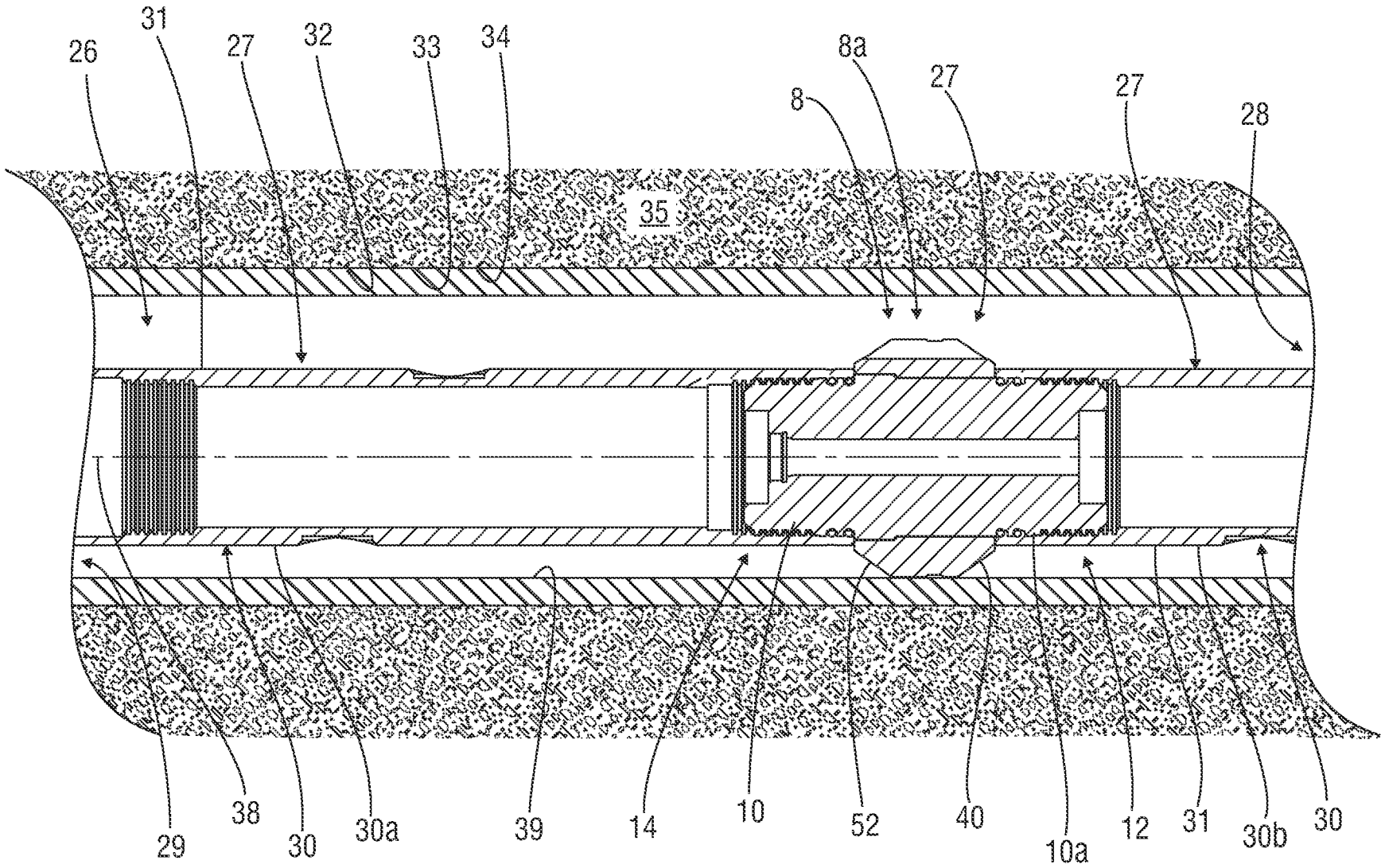
FIG. 1 is a partial cross-sectional view of an exemplary tandem spacer shown connected in a tool string deployed in a horizontal section of a downhole borehole in accordance with embodiments of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent (or any patent or patent application claiming priority hereto). On the contrary, the intention is to cover all modifications, equivalents and alternatives falling within the spirit and scope of this disclosure and the claims. Many changes may be made to the particular embodiments and details disclosed herein without departing from such spirit and scope.

In showing and describing preferred embodiments in the appended figures, common or similar components, features and elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. It should also be noted that the use of "(s)" in reference to an item, aspect, component, feature or action (e.g. "surface(s)") throughout this patent should be construed to mean "at least one" of the referenced item, aspect, component, feature or act.

Certain terms are used herein and in the appended claims to refer to particular components. As one skilled in the art will appreciate, different persons may refer to a component by different names and this document does not intend to distinguish between components that differ in name but not function. Also, the terms "including" and "comprising" are used herein and in the appended claims in an open-ended fashion, and thus should be interpreted to mean "including, but not limited to . . . ". Further, reference herein and in the appended claims to components and aspects in a singular tense does not necessarily limit the present disclosure or appended claims to only one such component or aspect, but should be interpreted generally to mean one or more as may be suitable and desirable in each particular instance, and the use of "(s)" in reference to an item, aspect, component, feature or action (e.g. "surface(s)") should be construed to mean "at least one" thereof, except and only to the extent as may be expressly specified otherwise herein or in a particular claim hereof and only for such claim(s) and any claim(s) depending therefrom.

When reference numbers are followed by a lowercase letter (e.g. connectors 110*a*, 110*b*), they are each the same type of component (e.g. connector 110) having the same features described herein and shown in the appended drawings for the commonly referenced feature (e.g. connector 110) or which are apparent therefrom, but having a different location, use or other characteristic(s). Parenthetical phrases starting with "e.g.", such as (e.g. tool string), are meant to provide one possible example of the referenced feature or circumstance that may occur in some instances. Such examples are not required for every embodiment or any claims, except and only the extent as may be explicitly provided otherwise herein.

As used throughout this patent, the following terms have the following meanings, except and only to the extent as may be expressly specified otherwise:

The term "and/or" as used herein provides for three distinct possibilities: one, the other or both. All three possibilities do not need to be available—only any one of the three. For example, if an embodiment of a component is described as "having a collar and/or a coupling", it may include only one or more collars, only one or more couplings or at least one of each. Thus, the use of "and/or" herein does not require all three possibilities, just any one or more of the three possibilities. A claim limitation herein that recites "having a collar and/or a coupling" would be literally infringed by a device including only one or more collars, one or more couplings or both one or more couplings and one or more collars.

The terms "coupled", "connected", "engaged" and the like, and variations thereof refer to and include either an indirect or direct connection or engagement. Thus, if a first device couples to a second device, that connection may be through a direct connection, or through an indirect connection via other devices and/or connections.

The terms "downhole" and variations thereof refer to an include in a hole, space or other area that may be underground or aboveground and within which a tool string maybe used.

The terms "elongated" and variations thereof mean an item having an overall length (during the intended use of the item) that is greater than its average width.

The terms "gauge ring" and variations thereof mean and include an at least substantially ring-shaped member (or combination of members) having a desired, known or measurable outer diameter.

The terms "generally", "substantially" and variations thereof mean and include greater than 50%.

The terms "gripping tool" and variations thereof refer to and include a pipe wrench or any other device or system useful for releasably gripping any other device or item.

The terms "operator", "assembler" and variations thereof mean and include one or more humans, robots or robotic components, artificial intelligence-driven components/circuitry, other components and the like.

The terms "outer diameter", "OD" and variations thereof when used in reference to a component, collection of components (e.g. tool string), feature or other subject matter include the maximum outer diameter or width of the referenced component, collection of components or other subject matter. (In some instances, the term "maximum outer diameter" is used.)

The terms "perforating gun string", "gun string" and variations thereof mean and refer to a tool string that include at least one downhole perforating gun.

The terms "rigidly engaged", "rigidly secured", "rigidly sandwiched" and the like and variations thereof mean that one or more of the referenced components is not (e.g. more than insubstantially or minimally) moveable during typical, or expected, operations relative to at least one other component in at least one axis or plane. In other words, if component A is rigidly sandwiched between components B & C in a longitudinal axis, component A is not movable (more than nominally) relative to components B and/or C in that axis during typical or expected operations.

The terms "tool" and variations thereof refer to and include one or more devices or items of equipment insertable into a hole, space or area, such as, for example, an underground borehole. In oilfield operations, for example, the tool may be a device or equipment used during well drilling, completion, intervention, production, workover or other activities. However, the term "tool" as used herein is not limited to oilfield devices and functions or use in only underground borehole operations.

The terms "tool string" and variations thereof refer to and include one or more interconnectable tools, components, parts or devices useful for performing one or more tasks or functions and insertable into a hole, space or area, such as, for example, an underground borehole. In oilfield operations, for example, the tool string may include tools used during well drilling, completion, intervention, production, workover or other activities in an underground borehole. However, the term "tool string" as used herein is not limited to oilfield devices, equipment and functions or use in only underground borehole operations.

It should be noted that any of the above terms may be further explained, defined, expanded or limited below or in other parts of this patent. Further, the above list of terms is not all inclusive, and other terms may be defined or explained below or in other sections of this patent.

Referring initially to FIG. 1, a typical (e.g. oilfield) tool string 26 includes one or more tools 27 aligned and/or interconnected in a common longitudinal axis 38 to allow its insertion into, movement within and removal from an underground borehole 32 in an earthen formation 35. One or more underground walls 33 normally at least partially surrounds the borehole 32 in the earthen formation 35. For the purposes of this patent, the borehole wall 33 can include any combination of earthen material, one or more casings 34 or other materials or components that at least partially surround or form the borehole 32. Thus, the present disclosure is not limited to use in boreholes 32 having casings 34, except and only to the extent as may be expressly specified otherwise, such as in a particular claim and only for such claim and claims depending therefrom. In the illustrated example, the tool string 26 is a perforating gun string and the tools 27 include multiple perforating guns 30, but the tool string 26 could include any desired quantity and types of tool(s) 27. A first exemplary gun 30*a* is shown rearward of an interconnected second gun 30*b*, each gun 30*a*, 30*b* including at least one carrier, or outer body, 31. It should be understood that this patent is not limited in any way to, or by, any of the details in this paragraph, except and only to the extent as may be expressly specified otherwise herein or in a particular claim hereof and only for such claim(s) and any claim(s) depending therefrom.

To assist the reader in following the description herein, features of the exemplary spacers 8 (described below) of the present disclosure and other components and features may be described in the context of their "ends", namely having forward and rear ends that are shown and described relative to, or which correlate with, the forward and rear ends of the exemplary tool string 26. For such context, the end of the tool string 26 typically inserted first into the borehole 32 (or other area) is sometimes referred to herein as the "forward end 28", and the opposite end of the tool string 26 (normally at or closest to the surface or entry point into the borehole 32) is sometimes referred to herein as the "rear end 29" of the tool string 26. However, reference to the forward and rear ends of the tool string 26, spacers 8 and any components thereof or other features is for illustrative purposes only. The exemplary spacers 8 (described below) of the present disclosure and other components and features are thus not limited by, or to, any reference to their forward and rear ends as described or shown herein. In other words, they may be reversible or reverse-oriented. For example, anything described and shown at the forward end of an exemplary spacer 8 or component thereof for one or more embodiments herein may instead be at the rear end of the same spacer 8 or components thereof in other embodiments.

Figure 2:
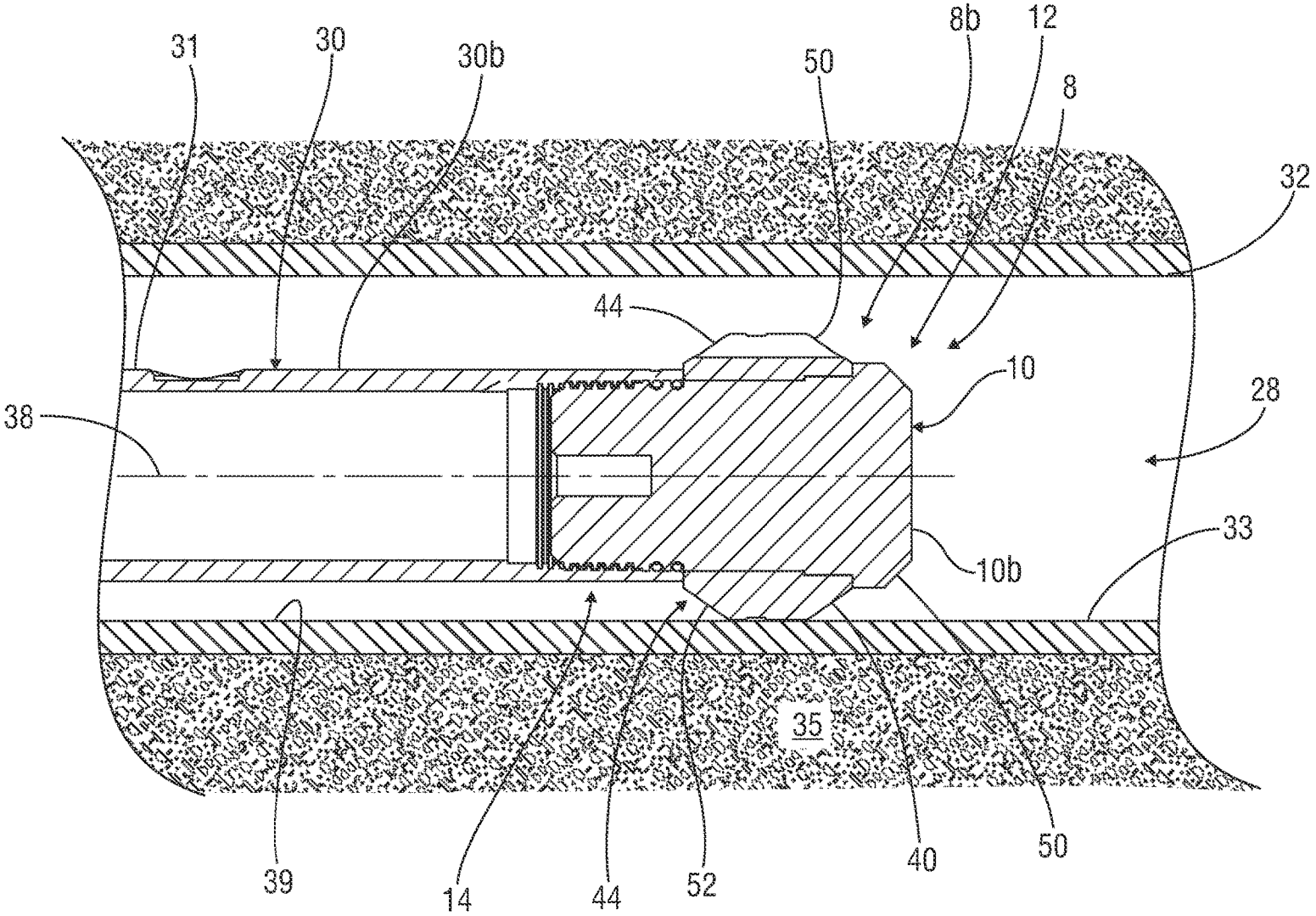
FIG. 2 is a partial cross-sectional view of an exemplary bottom spacer shown connected at the forward end of the tool string of FIG. 1.

Referring now to FIGS. 1 & 2, in accordance with various embodiments of the present disclosure, each figure shows an exemplary gauge-ring assembly, or spacer, 8 for use in a tool string 26. Each exemplary spacer 8 includes at least one mandrel 10 and at least one gauge ring 40 extending at least partially radially outwardly therefrom. The exemplary mandrel 10 is a cylindrical member configured to locate the gauge ring(s) 40 associated therewith radially and axially when deployed in the borehole 32. However, the mandrel 10 may have any other desired shape and configuration.

In FIG. 1, the illustrated spacer 8, sometimes referred to herein as a "tandem spacer 8*a*", is shown positioned between and connecting two other tools 27 of the tool string 26 and its mandrel 10 is sometimes referred to herein as a tandem mandrel, or sub, 10*a*. In FIG. 2, the exemplary spacer 8, sometimes referred to herein as an end, or bottom, spacer 8*b*, is shown positioned at the forward end 28 of the tool string 26 and its mandrel 10 takes the form of a bottom mandrel, or sub, 10*b*. While there may be instances where the exemplary spacers 8*a*, 8*b* are used in the same tool string 26, there is no generally overriding need or requirement to do so. In many applications, only one or multiple exemplary tandem spacers 8*a* may be used, and in many other applications only an end spacer 8*b* may be used.

It should be noted that all the features and actions described herein and shown in the appended drawings with respect to the exemplary tandem spacer 8*a* and mandrel 10*a*, or which are otherwise evident therefrom, are similarly applicable to the exemplary end spacer 8*b* and mandrel 10*b*, respectively, to the extent not in conflict with any other details, features or capabilities explicitly provided herein or as may be apparent from this specification and the appended drawings, and vice versa. Furthermore, although the illustrated spacers 8*a*, 8*b* and mandrels 10*a*, 10*b* may have many similar respective features, each represents a different and independent aspect of the present disclosure and is believed to be independently patentable.

Figure 3:
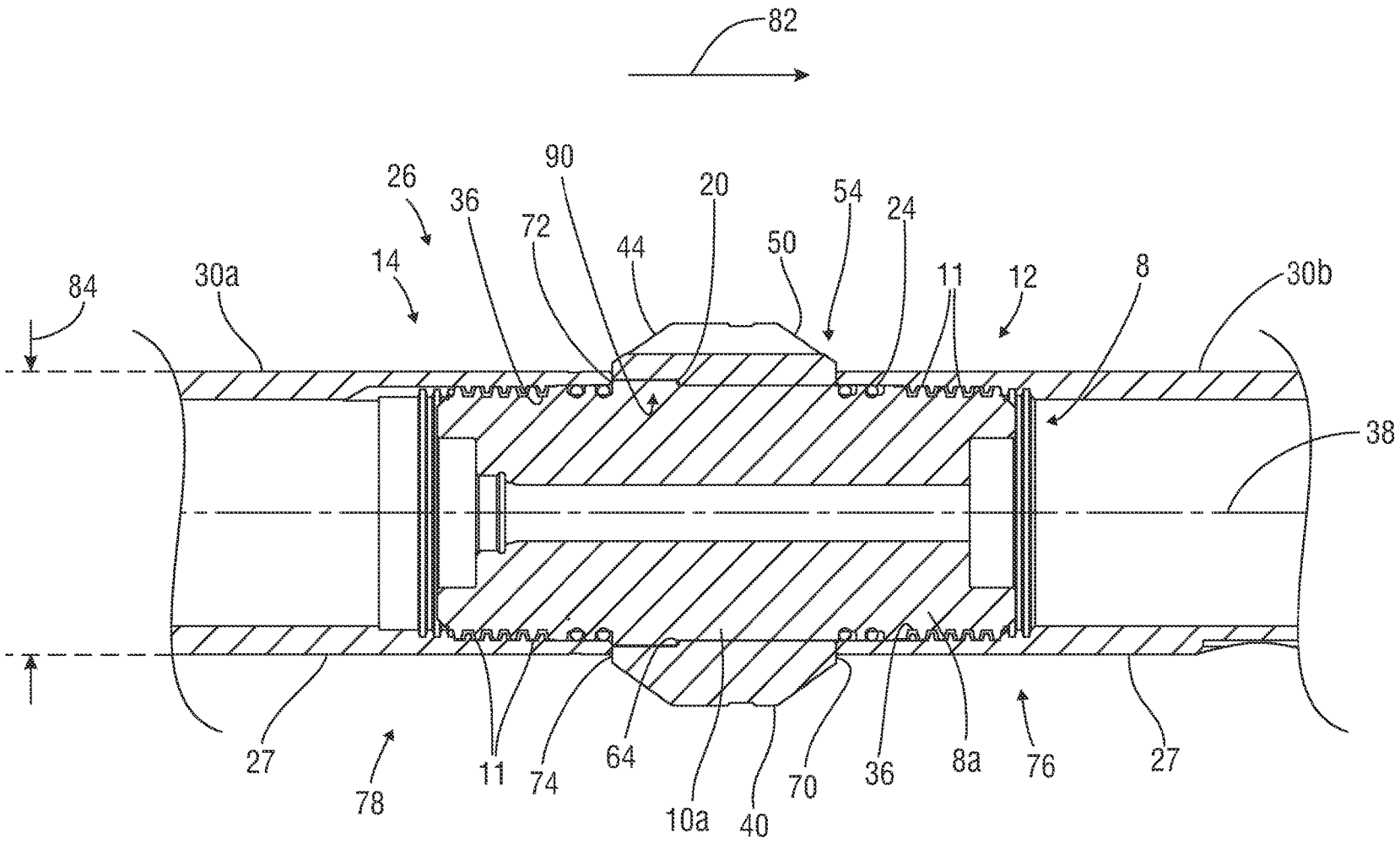
FIG. 3 is a cross-sectional view of the exemplary tandem spacer of FIG. 1 without showing the borehole.
Figure 4:
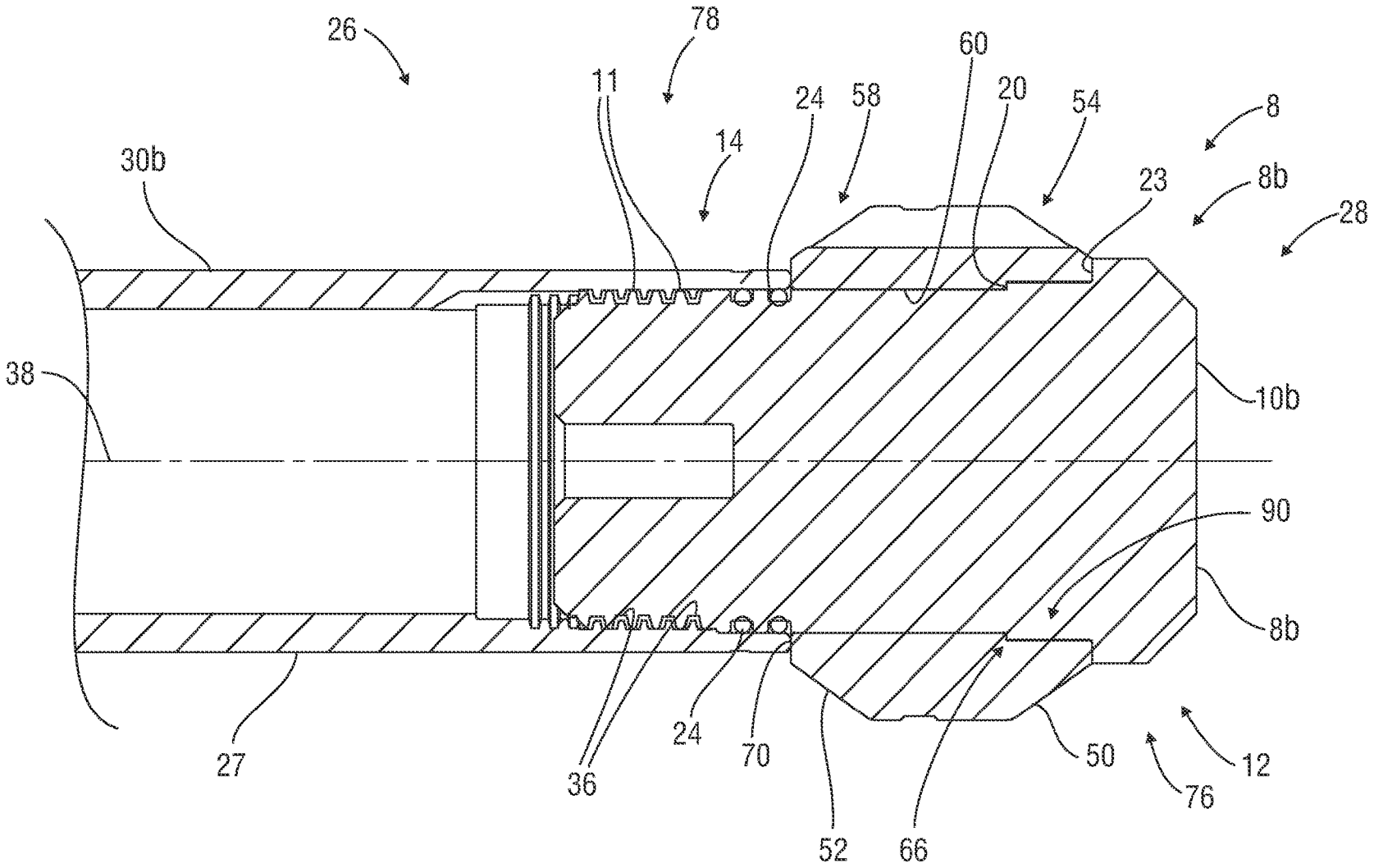
FIG. 4 is a cross-sectional view of the exemplary bottom spacer of FIG. 2 without showing the borehole.

Now referring to FIGS. 3 & 4, each exemplary spacer 8 may be engageable with one or more adjacent tools 27 of the tool string 26. In this embodiment, the tandem spacer 8*a* is selectively, releasably engageable with the adjacent tools 27 at its respective forward and rear ends 12, 14, while the end spacer 8*b* is selectively, releasably engageable with the adjacent tool 27 only at its rear end 14. The illustrated tandem spacer 8*a* is thus engaged between and mechanically connects the first and second perforating guns 30*a*, 30*b*, and the exemplary end spacer 8*b* engages the second perforating gun 30*b* and serves as the forward-most tool 27 (e.g. acting as a bull-nose) on the tool string 26.

The exemplary spacers 8 may be selectively releasably engageable with one or more other tools 27 of the tool string 26 in any suitable manner. In the present embodiments, the adjacent tool(s) 27 extend at least partially over the adjacent mandrel(s) 10 for their mateable engagement, such as with a threaded connection. For example, each mandrel 10*a* of the tandem spacer 8*a* may include male threads 11 at its forward and/or rear ends 12, 14 for threadable engagement with female threads 36 of the adjacent tools 27 (e.g. perforating guns 30*a*, 30*b*), and each mandrel 10*b* of the end spacer 8*b* may include male threads 11 at its rear end 78 for threadable engagement with female threads 36 of the tool 27 (e.g. perforating gun 30*b*). Of course, the thread type could be reversed, if desired. One or more seals 24 (e.g. O-ring seals) may be provided between each exemplary mandrel 10 and its adjacent tool(s) 27 (or elsewhere) to provide a fluid, or liquid, tight seal therebetween, isolate pressure between the outside and inside of the tools string 26, for any other purpose(s) or a combination thereof. However, any other technique and components for engaging the exemplary spacer 8 with one or more adjacent tools 27 on the tool string 26 may be used. In some embodiments, the spacers 8 may not be engaged with each adjacent tool 27, but provided in the tool string 26 in a different manner.

Referring back to FIGS. 1 & 2, the exemplary spacer 8 can be used for any suitable purpose(s). In an independent aspect of the present disclosure, for example, one or more spacers 8 may be used to provide one or more pump-down features 44 for the tool string 26. Pump down techniques are sometimes used to assist in moving or deploying the tool string 26 in or through the borehole 32. For example, at some point in deploying a tool string 26 into a horizontal well (e.g. via wireline), such as when the tool string 26 passes through the heel of the borehole 32 and into a lateral portion, the friction caused by the moving tool string 26 may slow or stop the forward progress of the tool string 26. Pump down often involves the use of fluid pumps at the surface to pump fluid into the borehole 32 and against the top, or other part(s), of the tool string 26 or one or more tools 27 thereon (a.k.a. the pump-down feature 44), creating a pressure differential to hydraulically drive the tool string 26 forward or further down in the borehole 32. The pump-down feature 44 essentially acts as a piston moving in the borehole 32.

When this capability is included, one or more spacers 8 can be used to provide one or more pump-down features 44 in any suitable manner. For example, the spacer 8 may include one or more pump-down surfaces 52 designed to extend radially outwardly into the borehole 32 from the tool string 26 beyond the maximum OD 84 (FIG. 3) of the tool string 26 and other tools 27 thereon (at least rearward of the spacer 8) so that as fluid pressure is applied (e.g. from the surface) for pump down, wellbore fluid acts against one or more pump-down surfaces 52 to effectively push the spacer 8 and tool string 26 forward in the borehole 32. In the present embodiments, pump-down surface(s) 52 of each spacer 8 are provided on one or more rearward facing surface of the gauge ring 40, but could be on any other portions of the gauge ring 40 an/or any other part or component of the spacer 8.

Oftentimes, the larger the diameter of the pump-down feature 44 of the tool string 26, the higher the pressure choke between the pump-down feature(s) and the borehole wall 33. Thus, in some instances, the OD-size of the pump-down feature 44 may be selected to achieve a desired pump-down rate or capability. With the present embodiments, one or more pump down surfaces 52 can be provided across at least part of the width of each among a series of gauge rings 40 having different respective maximum outer diameters 86 for easy switch-out to accommodate differing pump-down objectives.

In various embodiments, the exemplary pump down feature(s) 44 may extend angularly radially outwardly from the spacer 8 so that such angle can affect the pump-down rate or capability. In some instances, for example, the more gradual the angle of the pump down surface(s) 52 relative to the longitudinal axis 38 of the spacer 8, the lower the pump down rate or velocity. Thus, different exemplary gauge rings 40 can be formed having pump down surfaces 52 extending at different angles for easy switch-out to accommodate differing pump-down objectives.

Still referring to FIGS. 1 & 2, if desired, the location in the tool string 26 of one or more exemplary spacers 8 with the pump-down capability can be selected to match the needs of a particular operation. In some operations, on one or more tandem spacers 8*a* having pump-down surfaces 52 may be placed at any desired location(s) in the tool string 26 to provide the pump-down capability. The use of one or more tandem spacers 8*a* with one or more pump-down features 44 (e.g. pump down surface(s) 52) may be useful in some situations, for example, when the tool string 26 does not include a plug (e.g. at its forward end 28), a misrun has occurred after the plug (e.g. at the forward end 28) of the tool string 26 has been set but one or more tools 27 (e.g. perforating guns 30) are still required in the borehole 32, or in other situations. In other operations, it may only be necessary or desirable to have an exemplary end spacer 8*b* with one or more pump-down features 44 (e.g. pump-down surface(s) 52) at the forward end 28 of the tool string 26 to provide the pump-down capability. Accordingly, in various embodiments, one or more exemplary tandem spacers 8*a* and/or end spacers 8*b* may provide the pump-down feature 44, such as to convey wireline perforating guns 30 into horizontal or highly deviated wells or for any other purposes.

Still referring to FIGS. 1 & 2, another potential independent purpose of the exemplary spacer 8 may be to space (standoff) at least part of the tool string 26 away from at least part of the borehole wall 33. For example, in some downhole perforating operations, at least one exemplary spacer 8 may be used at one or multiple locations in the tool string 26 to lift one or more perforating guns 30 up off of, or away from, the bottom 39 of the borehole wall 33 (e.g. casing 34) in horizontal or highly deviated boreholes 32, move one or more perforating guns 30 closer to the center or one side of the borehole wall 33, achieve or improve consistency of perforation of the earthen formation 35, for any other purpose(s) or a combination thereof.

In some instances, an exemplary tandem spacer 8*a* may be provided on each side of each perforating gun 30 in the tool string 26, while some situations may warrant including an end spacer 8*b*, to assist with standoff. When pump-down is needed in addition to the standoff capability, one or more exemplary tandem spacers 8*a* having pump-down surfaces 52 (or other pump-down features 44) may be used (e.g. nearest to the rear end 29 of the tool string 26). In various operations when the pump-down capability is needed but standoff is not needed, an exemplary end spacer 8*b* may be employed without any tandem spacers 8*a* (e.g. saving cost, time and manpower). Thus, any combination of tandem and end spacers 8*a*, 8*b* may be used.

Still referring to FIGS. 1 & 2, when the standoff capability is provided, the exemplary spacers 8 can provide standoff in any suitable manner. For example, the spacer 8 may be configured to extend radially outwardly into at least part of the borehole 32 beyond the maximum OD 84 (FIG. 3) of one or more tools 27 on the tool string 26 thereon to position such tools 27 in the borehole 32 as desired. In the present embodiments, the maximum OD 86 of the gauge ring 40 is configured to provide the standoff capability. If desired, the shape and configuration of the gauge ring 40 and/or the size of the OD 86 (e.g. width) of the gauge ring 40 can be designed or selected to accomplish a desired amount and location (in the borehole) of standoff. However, any other parts or components of the spacer 40 could provide standoff in any suitable manner.

With the present embodiments, a series of different gauge rings 40 may be formed having various sized outer diameters 86, shapes and/or configurations for easy switch-out to accommodate differing standoff objectives. For example, an operator with a tool string 26 having one or more 2¾" OD perforating guns 30 can evaluate where the guns 30 will sit in relation to the center of the casing 34, then determine how much standoff is desired based upon the explosives, shape-charge performance of the perf guns 30, other variables or a combination thereof. With numerous sized exemplary gauge rings 40 available, the operator can spec out the gauge ring size (e.g. 4.0" OD) desired to lift the guns 30 up off the bottom of the casing 34 the desired distance. However, the present disclosure is in no way limited to this hypothetical example.

Still referring to FIGS. 1 & 2, yet another potential independent purpose of one more exemplary spacers 8 may be to help avoid, minimize or prevent undesirable contact of other tools 27 on the tool string 26 with the borehole wall 33 and/or wear to the other tools 27 from such contact. For example, the spacer(s) 8 can be used to space at least part of one or more other tools 27 away from the borehole wall 33 throughout deployment or during part of the deployment of the tool string 26 in the borehole 32. Isolating at least part of one or more other tools 27 (e.g. setting tools) from undesirable contact with the borehole wall 33 may be warranted to avoid wear and/or damage to the other (e.g. expensive) tools 27, reduce or eliminate the need to repair or replace such other tool(s) 27, save on the cost, complexity and downtime of repairing or replacing the other tool(s) 27, preserve or extend the useful lifespan thereof, for any other purposes or a combination thereof. For example, the gauge ring(s) 40 may be sized and positioned to serve as the wear portion(s) of the tool string 26 or a portion thereof and be replaced when worn.

The exemplary spacers 8 can at least partially isolate other tools 27 on the tool string 26 from contact with the borehole wall 33 in any suitable manner. For example, the spacer 8 may be configured to extend radially outwardly into at least part of the borehole 32 beyond the maximum OD 84 (FIG. 3) of one or more other tools 27 in the tool string 26 to prevent undesirable contact with the borehole wall 33. In the present embodiments, the maximum OD 86 (FIG. 5) of the gauge ring 40 is configured to provide this capability. However, any other parts or components of the spacer 8 could be configured to at least partially isolate other tools 27 on the tool string 26 from contact with the borehole wall 33.

It should be noted that the spacers 8*a*, 8*b* could, if desired, have any additional or different (e.g. conventional) purposes or functions, such as, for example, providing one or more pressure seals in the tool string 26. For another example, the tandem spacer 8*a* may both mechanically connect and pass electrical signals between the tools 27 adjacent thereto or additional or different tools 27 on the tool string 26.

Now referring to FIGS. 5-8, the gauge ring 40 may have any suitable form, configuration, construction, components and operation. In the present embodiments, the gauge ring 40 has a maximum width, or OD, 86 which forms the maximum OD of the spacer 8. The exemplary gauge ring 40 is also releasably engageable with the mandrel 10, providing for easy replacement of the gauge ring 40 (e.g. due to wear) without replacing the entire spacer 8. For example, the illustrated gauge ring 40 has an internal bore 62 configured to fit over at least part of the outer surface 18 of the mandrel 10, so that the gauge ring 40 and mandrel 10 may be slidably engaged and disengaged. The exemplary gauge ring 40 is thus easily removable from the mandrel 10 by sliding it off the mandrel 10 and without having to uncouple any threads or other engagement mechanisms therebetween. However, in other embodiments, the gauge ring 40 and mandrel 10 may be releasably engageable in any other manner (e.g. gauge ring 40 snaps or clips onto the mandrel 10), integrally formed or otherwise not separable and/or one or more engagement mechanisms (threads, interlocking members, etc.) may be included for directly coupling the gauge ring 40 and mandrel 10 together.

If desired, a variety of different versions of gauge rings 40 may be used with the same mandrel 10. For example, when it is desired or necessary to change the OD 86 (or other characteristic) of the gauge ring 40 or for any other purposes, the entire spacer 8 not need be replaced, only the gauge ring 40. In the present embodiments, the same mandrel (tandem sub) 10*a* of the tandem spacer 8*a* can accommodate multiple different-sized or configured gauge rings 40, and the same mandrel (bottom sub) 10*b* of the end spacer 8*b* (e.g. FIG. 2) can accommodate multiple different-sized or configured gauge rings 40. In some embodiments, the same gauge rings 40 may be used with both tandem subs 10*a* and bottom subs 10*b*. Accordingly, the removability of the exemplary gauge rings 40 from the mandrels 10 may result in substantial time, manpower, effort and cost savings and reduction in the complexity of manufacturing, operations, potential failure points, packaging and shipping, delivery, inventory and space management and disposal.

Referring still to FIGS. 5-8, if desired, an inventory of different types of gauge ring 40 options, such as in material construction, configurations, symmetry (e.g. eccentric shape with its bore 62 not in its geometric center), size, dimension(s) (e.g. outer diameter 86) or any other characteristic(s) may fit with the same type(s) of mandrel 10*a*, 10*b*. For example, multiple different OD-sized gauge rings 40 (e.g. 3.50", 3.55", 3.60" and 4.00" OD) may be available for use with a mandrel 10 having a 2¾" OD; multiple different OD-sized gauge rings 40 (e.g. 3.60", 3.65", 3.75", 4.00", 4.25", 4.30" and 4.50" OD) may be available for use with a mandrel 10 having a 3⅛ "OD; and multiple different OD-sized gauge rings 40 (e.g. 3.65", 3.75", 4.00", 4.25", 4.30" and 4.50" OD) may be available for use with a mandrel 10 having a 3⅜ "OD. However, the above examples are illustrative only and not limiting upon the present disclosure; and any other sizes of corresponding mandrels 10 and gauge rings 40 may be provided. Having an inventory of different versions of exemplary gauge rings 40 useful with the same version(s) of the mandrel(s) 10*a*, 10*b* may provide operators with a wider variety of downhole capabilities, more precisely and easily match the spacer(s) 8 to the tools, functions, requirements or (e.g. changing) conditions or demands of a deployment, improve performance, speed and efficiency of downhole operations, provide other benefits or a combination thereof.

Referring still to FIGS. 5-8, in another independent aspect, in some embodiments, the spacer 8 may include or provide at least one fluid flow passageway 46 to allow some fluid to bypass the spacer 8 under certain circumstances when positioned in the borehole 32, for any other purpose(s) or a combination thereof. For example, the fluid flow passageways 46 may allow some fluid to bypass the spacer 8 during deployment to allow debris in the path of the spacer 8 to be washed away from the spacer 8 during movement of the tool string 26 in the borehole 32 (e.g. FIG. 1), help prevent the spacer 8 (and tool string 26) from sticking in the borehole 32, allow the tool string 26 to be pulled out of the borehole 32 without delay or at a rapid speed, have any other purpose(s) or a combination thereof.

When included, the fluid flow passageways 46 may have any suitable form, configuration, location, construction and operation. In the present embodiment, the fluid flow passageways 46 include three fluid flow channels 48 formed in the outer surface 42 of the gauge ring 40 and extending generally between the forward and rear ends 54, 58 thereof. When included, the exemplary flow channels 48 can be formed with any desired depth, width and location in the gauge ring 40. However, the gauge ring 40 may include fewer (1 or 2) or more (4, 5, 6 etc.) flow channels 48 and/or any different types of fluid flow passageways 46 (e.g. orifices or internal passages extending at least partially through the gauge ring 40) provided at any desired locations in or on the gauge ring 40 or other component of the spacer 8. In some embodiments, the gauge ring 40 may not include any fluid flow passageways 46, or one or more other components of the spacer 8 may include fluid flow passageway(s) 46.

In another independent aspect of the present disclosure, the gauge ring 40 may extend radially outwardly around the entire circumference of the mandrel 10, or alternately, extend outwardly around only part of the mandrel 10 (e.g. at two, three, four or more different locations along the circumference of the mandrel 10). In the illustrated embodiments, the gauge ring 40 of each exemplary spacer 8 extends radially outwardly around its entire circumference, except for the spaces formed by the flow channels 48.

Still referring to FIGS. 5-8, in yet another independent aspect of the present disclosure, if desired, one or more portions of the outer surface(s) 42 of the exemplary gauge ring 40 and/or the outer surface(s) 18 mandrel 10 may be formed with or include one or more chamfers, or sloping surfaces, 50, such as to help avoid hang-ups thereof in the borehole 32 and/or allow easy movement of the spacer 8 into, through and from the borehole 32, for any other purpose(s) or a combination thereof. In the present embodiments, at least one chamfer 50 is provided at each end 54, 58 of the gauge ring 40 and the forward end 76 of the mandrel 10*b*. At least part of each illustrated chamfer 50 on the gauge ring 40 may serve as a pump down surface 52 depending upon the orientation of the spacer 8 in the borehole 32 (e.g. FIG. 2). The exemplary chamfers 50 may be formed at any particular angle(s) (e.g. 45°-55° or more or less) to achieve the desired result(s). However, other embodiments may include no, only one or more than two chamfers 50 for any desired purpose and at any desired location on the spacer 8. For example, multiple adjacent chamfers 48 (e.g. having different angles) may be provided at one or both ends 54, 58 of the gauge ring 40 (or other component(s)).

Still referring now to FIGS. 5-8, in yet another independent aspect of the present disclosure, the gauge ring 40 may be associated with or coupled to the mandrel 10 in any suitable manner. For example, the gauge ring 40 may be easily coupled to and removable from its associated mandrel 10 without any threads or other mechanical engagement mechanisms therebetween. Avoiding threaded or other mechanical engagement mechanisms between the gauge ring 40 and mandrel 10 can, for example, save time, manpower, cost and complexity in manufacturing and use, reduce the potential for loosening thereof and damage to the threads or other mechanical engagement mechanisms during deployment and use and/or provide other benefits.

In the present embodiments, the gauge ring 40 is moveable onto and off the mandrel 10. As mentioned, the illustrated gauge ring 40 is slidable over at least part of the outer surface 18 of the mandrel 10. With respect to the exemplary tandem spacer 8*a*, the rear end 58 of the illustrated gauge ring 40 is slidable (e.g. slip fit) over the forward end 12 of the mandrel 10 and onto its central body 16 in the direction represented by arrow 80. In this embodiment, such movement of the gauge ring 40 over the mandrel 10*a* stops when one or more anchors 64 of the gauge ring 40 engage one or more stops 20 of the mandrel 10*a*, establishing one or more desired operating positions of the gauge ring 40 (e.g. FIG. 3).

The exemplary gauge ring 40 is removable from its associated mandrel 10*a* by sliding it in the opposite direction. Thus, the illustrated gauge ring 40 is separate and distinct, and easily removable, from its associated mandrel 10*a*. However, any other techniques and components may be used to position the gauge ring 40 over, or relative to, its associated mandrel 10 or other component(s) of the spacer 8 (or vice versa), or otherwise move the gauge ring 40 into and out of one or more operating positions. For example, the gauge ring 40 may be snap, friction or press fit to, or clamped onto, the mandrel 10 or other component of the spacer 8, or vice versa. For another example, some embodiments may involve a threaded connection and/or other mateable or mechanical engagement mechanisms for coupling or associating the gauge ring 40 and mandrel 10 or other components.

Figure 6:
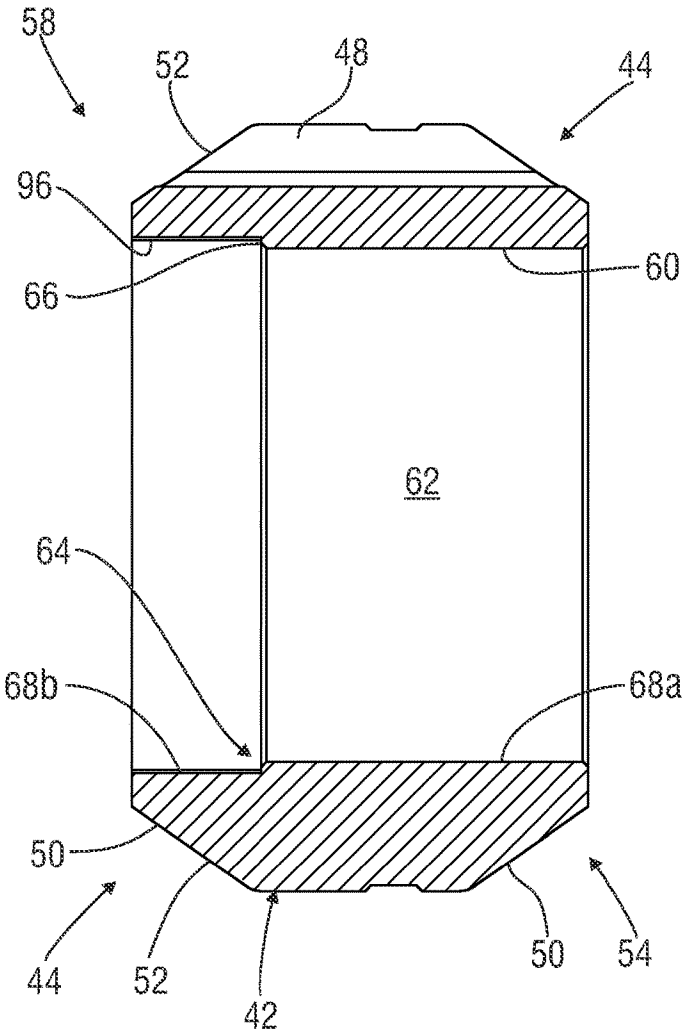
FIG. 6 is a cross-sectional view of the exemplary gauge ring of FIG. 5.
Figure 5:
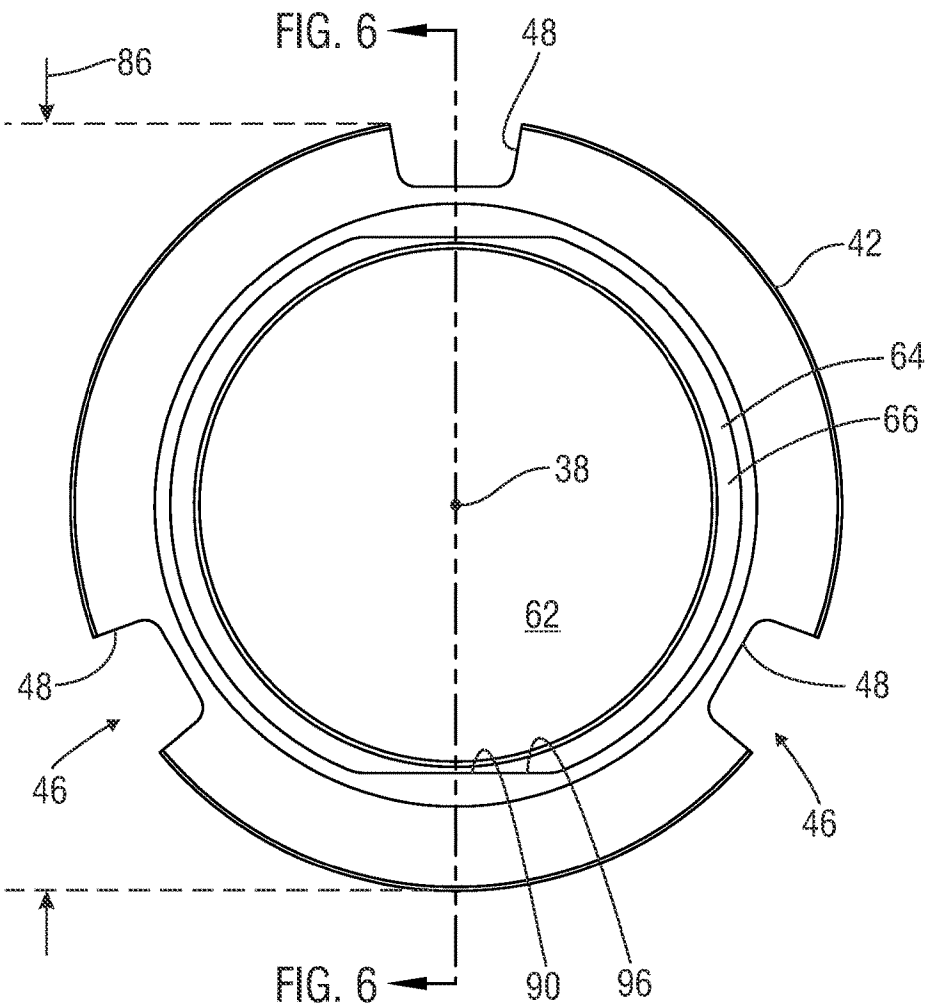
FIG. 5 is a bottom view of the exemplary gauge ring shown in FIG. 1 (looking from the rear end of the exemplary gauge ring or from left to right)
Figure 7:
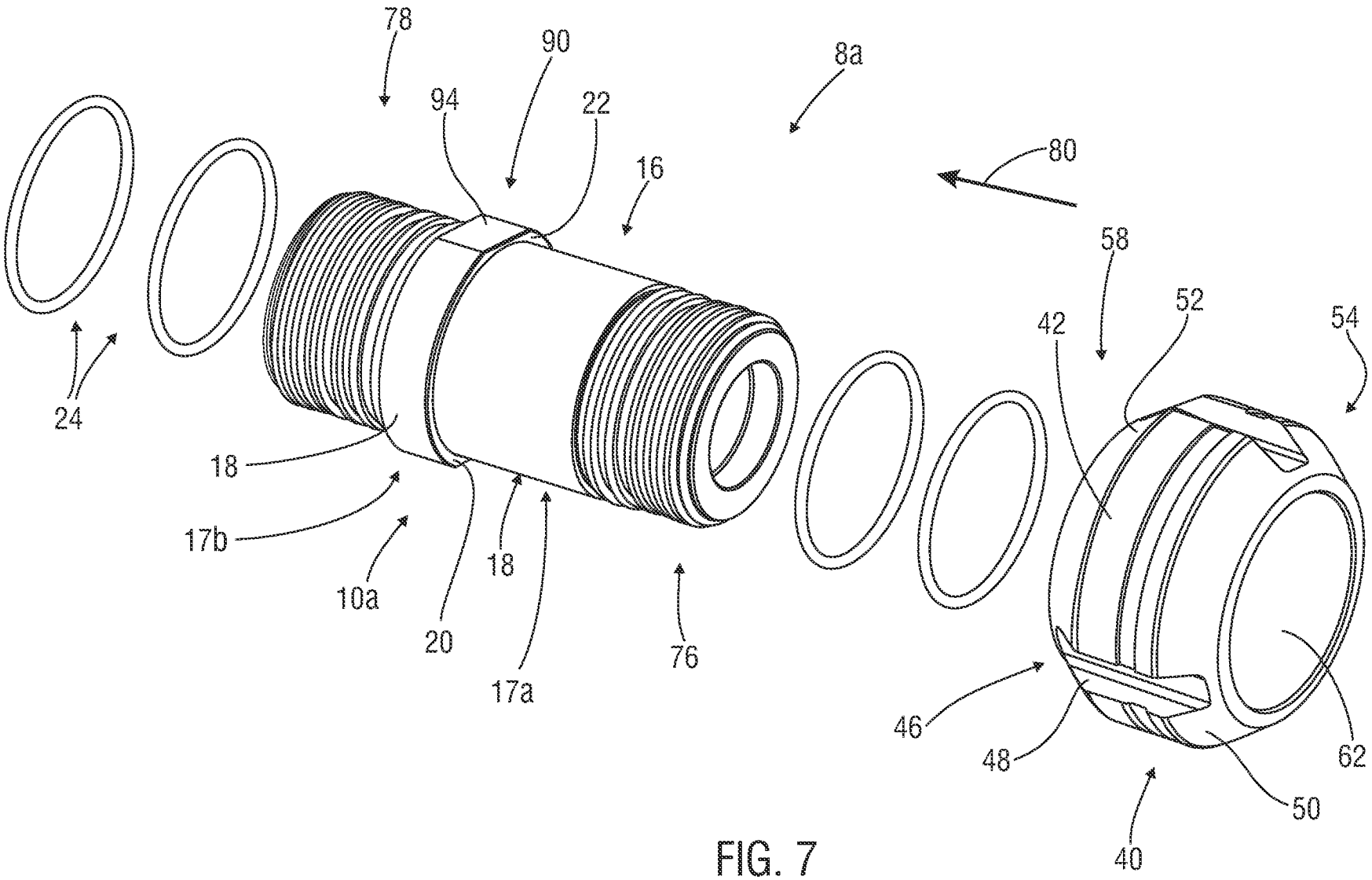
FIG. 7 is an assembly view of the exemplary tandem spacer shown in FIG. 1.

Referring now to FIGS. 5-7, when included, the anchor(s) 64 of the gauge ring 40 and stop(s) 20 of the mandrel 10 may have any suitable form, configuration, location, construction and operation. In the present embodiments, the anchor 64 of the gauge ring 40 includes one or more lips, or interior shoulders, 66 in the interior wall(s) 60 of the gauge ring 40 that surrounds its bore 62. For example, a single interior shoulder 66 may extend around the entire circumference of the bore 62, or only along a portion thereof, or multiple (e.g. circumferentially aligned) interior shoulders 66 may be formed at different positions around the bore 62.

When included, the exemplary interior shoulder(s) 66 of the gauge ring 40 may be provided in any suitable manner. For example, the interior wall 60 of the gauge ring 40 may include one or more small-ID sections 68*a* that provide an inner diameter of the bore 62 which is smaller than the inner diameter of the bore 62 formed by one or more large-ID sections 68*b* thereof, and where the intersection of the sections 68*a*, 68*b* defines or forms the interior shoulder(s) 66. The small and large-ID sections 68*a*, 68*b* may be formed integrally (e.g. via casting or molding), from different components coupled together (e.g. a ring welded inside the bore 62 forming the small-ID section 68*a*) or in any other desired manner.

Figure 9:
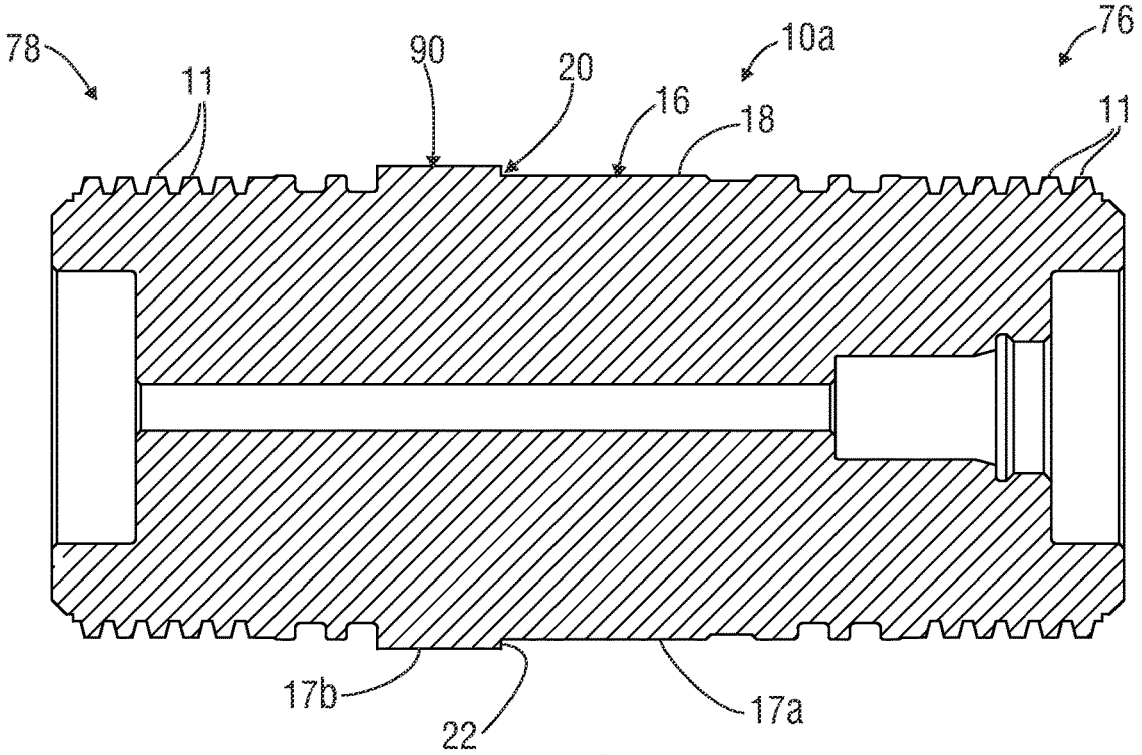
FIG. 9 is a cross-sectional view of the exemplary tandem spacer of FIG. 1.
Figure 10:
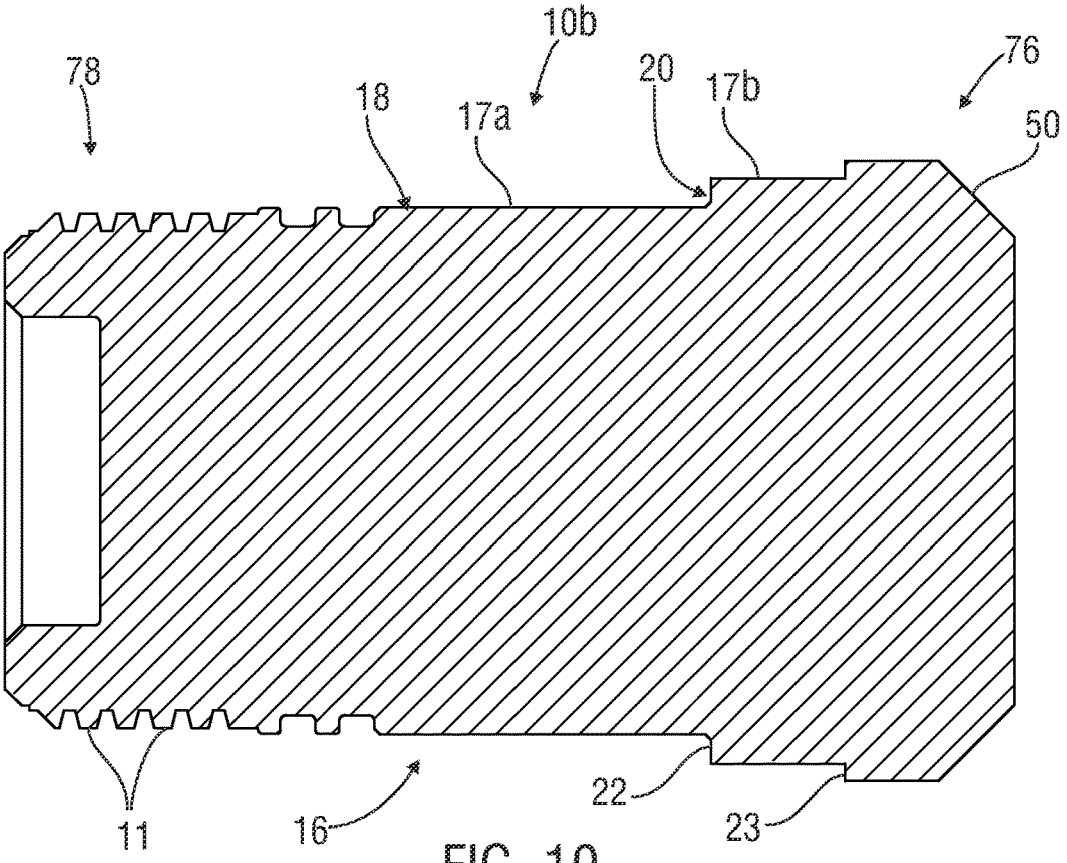
FIG. 10 is a cross-sectional view of the exemplary bottom spacer of FIG. 2.

Still referring to FIGS. 5-7, the illustrated stop 20 of the exemplary mandrel 10, when included, may have one or more protrusions, or shoulders, 22 extending from, or provided in or on, its outer surface 18. For example, a single exterior shoulder 22 may extend around the entire circumference of the mandrel 10, or only along a portion thereof, or multiple (e.g. circumferentially aligned) exterior shoulders 22 may be formed at different positions around the mandrel 10. The exterior shoulder(s) 22 may be provided in any suitable manner. For example, the central body 16 of the mandrel 10 may include one or more small-OD sections 17*a* having an OD that is smaller than the OD of one or more large-OD sections 17*b* thereof, where the intersection of the sections 17*a*, 17*b* defines or forms the exterior shoulder(s) 22 (e.g. FIGS. 9 & 10). The small-OD and large-OD sections 17*a*, 17*b*, when included, could be formed integrally (e.g. via casting or molding), of different components coupled together (e.g. a ring welded to the outside of the mandrel 10 forming the large-OD section 17*b*) or in any other desired manner.

In the present embodiments, when the exemplary gauge ring 40 having small & large ID sections 68*a*, 68*b* is moved over the mandrel 10 having small & large OD sections 17*a*, 17*b* into one or more operating positions, the small-ID section 68*a* of the gauge ring 40 becomes at least partially positioned over the large-OD section 17*b* of the mandrel 10 and stops when the shoulders 66, 22 at least partially abut one another (e.g. FIG. 3). However, the anchor(s) 64 and stop(s) 20, when included, may have any other form, configuration, components, operation and location (e.g. corresponding ratchet-like components, pin-receiver couplers, etc.) and may interact or engage one another in any other suitable manner.

Referring back to FIG. 3, the gauge ring 40 may be retained, or secured, in one or more operating positions relative to the mandrel 10 (or other component) in any suitable manner. For example, the gauge ring 40 may be held in its operating position(s) by one or more other tools 27 on the tool string 26 (e.g. adjacent to the spacer 8). With respect to the illustrated tandem spacer 8*a*, for example, after the gauge ring 40 is slid or positioned over the mandrel 10*a*, the adjacent tool 27 at the forward end 12 of the spacer 8*a* can be used to retain the gauge ring 40 in one or more operating positions and prevent it from backing out of position. For example, when that adjacent tool 27 is fully, properly (e.g. threadably) coupled to the illustrated tandem mandrel 10*a*, it should at least partially abut the gauge ring 40 (e.g. at one or more lips, or edges, 70 thereof), ensuring the anchor(s) 64 of the gauge ring 40 properly engages (abuts) the stop(s) 20 of the mandrel 10*a* and retaining the gauge ring 40 in an operating position. However, any other technique and components may be used to secure the gauge ring 40 in one or more operating positions.

In some embodiments, the exemplary tandem spacer 8*a* can be designed to provide positive confirmation of proper mechanical connection thereof to the adjacent tool 27 at its forward end 12. For example, the tandem spacer 8*a* may be designed so that when such adjacent tool 27 is fully, properly engaged with the mandrel 10*a* at its forward end 12, it will abut, or shoulder up, against the forward end 54 of the gauge ring 40, not the mandrel 10*a*. Thus, in such instances, the proper application of sufficient torque applied to the threaded engagement between such adjacent tool 27 (e.g. the rear end of the exemplary second perforating gun 30*b*) and the forward end 12 of the exemplary spacer tool 8*a* will be achieved and confirmed when that tool 27 abuts the gauge ring 40 (and the anchor(s) 64 of the gauge ring 40 abut the stop(s) 20 of the mandrel 10*a*).

Still referring to FIG. 3, the adjacent tool 27 at the other end (the rear end 14) of the exemplary tandem spacer 8*a* is not needed to secure the gauge ring 40 in one or more operating positions relative to the mandrel 10 or prevent it from disconnecting. For example, the immediately adjacent tool 27 at the rear end 14 of the illustrated spacer 8*a* can be simply threadably engaged with the mandrel 10. If desired, that tool 27 at the rear end 14 of the exemplary spacer 8*a* may abut one or more edges 72 of the mandrel 10*a* and/or one or more edges 74 the gauge ring 40 when fully and properly engaged with the mandrel 10.

In some embodiments, that tool 27 (at the rear end 14 of the exemplary spacer 8*a*) may provide positive confirmation of its proper mechanical connection to the spacer 8*a*, assist in securing the operating position of the gauge ring 40, have any other purpose(s) or a combination thereof instead of or in addition to the action of the adjacent tool(s) 27 at the forward end 12 of the tandem spacer 8*a* as described above.

Accordingly, in the present embodiments, only the shouldering of the gauge ring 40 to the mandrel 10*a* and the adjacent tool 27 at the forward end 12 of the spacer 8*a* to the gauge ring 40 are needed to tighten the gauge ring 40 and mandrel 10*a* together. And the tightening of that adjacent tool 27 to the exemplary mandrel 10*a* secures them together and the gauge ring 40 in an operating position at the same time. In effect, only one connection (the spacer 8*a* to the adjacent tool 27 at its forward end 12) is required to secure and retain the illustrated gauge ring 40 in an operating position and without any threaded engagement or other distinct coupling mechanism between the gauge ring 40 and mandrel 10*a*, and only two connections (between the mandrel 10 and two adjacent tools 27) are needed to secure the spacer 8*a* in the tool string 26.

In other embodiments, any of the above connection arrangements may be reversed (or as mentioned earlier, the exemplary spacer 8 can be essentially flipped over). In other words, the gauge ring 40 may instead be engaged with the mandrel 10*a* of the tandem spacer 8*a* and secured in a desired operating position by instead moving or sliding the gauge ring 40 over the illustrated rear end 78 of the mandrel 10*a* and securing the adjacent tool 27 thereto by reversing or mirroring the above techniques and features at the opposite ends of the respective components. Thus, if desired, everything described in the any of the immediately preceding twelve paragraphs may be equally employed to allow the gauge-ring 40 to be secured to the mandrel 10*a* from its rear end 78 and in the direction of arrow 82.

Figure 8:
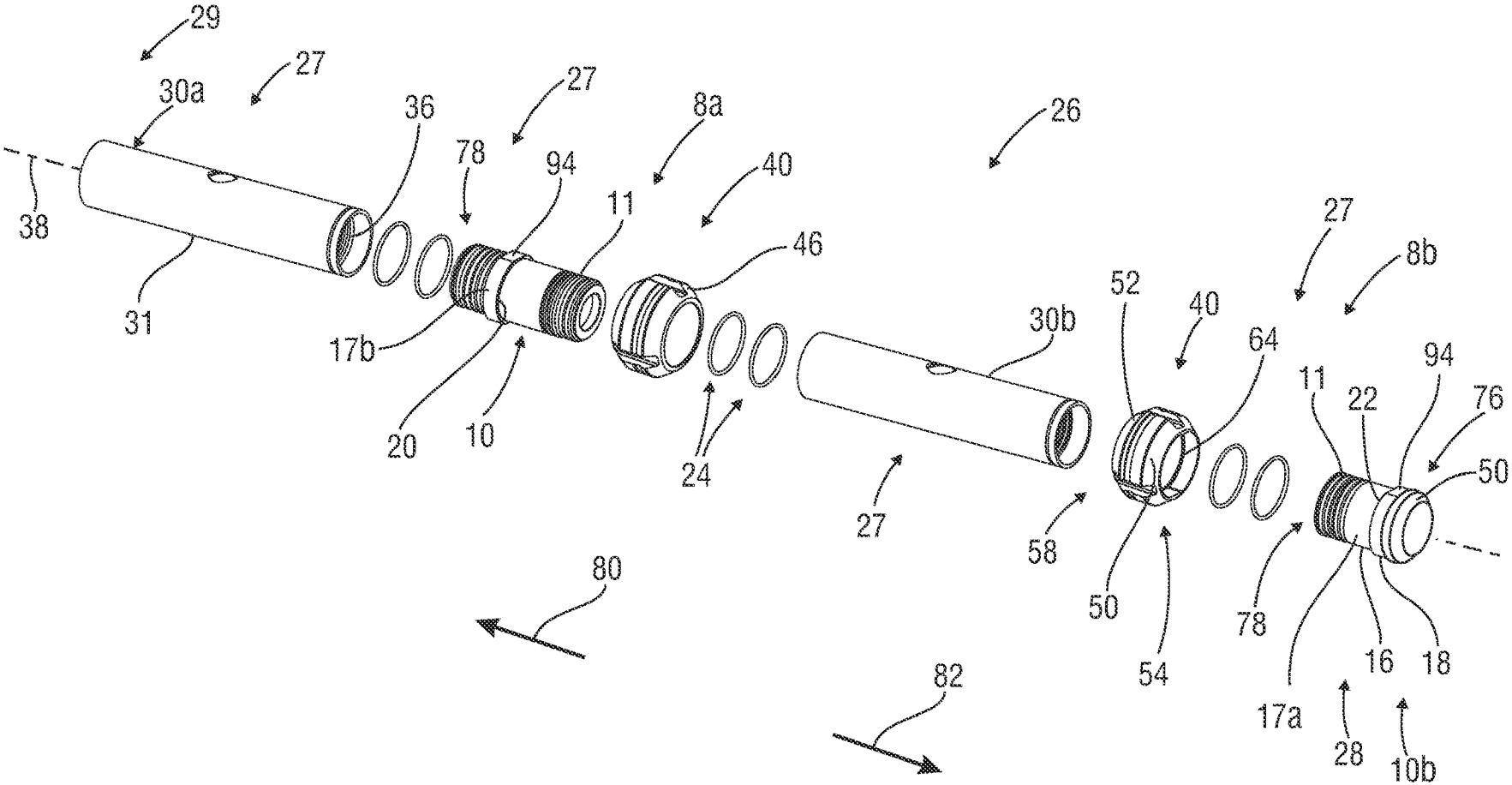
FIG. 8 is an assembly view of the exemplary tool string shown in FIGS. 1-2.

Now referring to FIGS. 4 & 8, for the illustrated end spacer 8*b*, the gauge ring 40 is engaged with the mandrel 10*b* similarly as described above with respect to the tandem spacer 8*a*, but from the rear end 14 of the spacer 8*b*. With that caveat and to the extent applicable with respect to the exemplary mandrel 10*b*, the above description relating to the tandem spacer 8*a* is hereby incorporated by reference herein in its entirely. For example, the forward end 54 of the illustrated gauge ring 40 is slidable from the rear end 78 of the mandrel 10*b* onto its central body 16 in the direction represented by arrow 82. Such movement of the exemplary gauge ring 40 over the mandrel 10*b* stops when one or more anchors 64 of the gauge ring 40 engage one or more stops 20 of the mandrel 10*b*, establishing one or more desired operating positions for the gauge ring 40. The exemplary gauge ring 40 is removable from its associated mandrel 10*b* by sliding it in the opposite direction. Thus, in this embodiment, the gauge ring 40 is separate and easily removable from its associated mandrel 10*b*. However, any other techniques and components may be used to position the gauge ring 40 over, or relative to, the mandrel 10*b*, or vice versa.

Also similarly as described above with respect to the tandem mandrel 10*a*, the exemplary anchor 64 of the gauge ring 40 and stop 20 of the bottom mandrel 10*b* may have any suitable form, configuration and operation. In the present embodiment, the anchor 64 includes one or more interior lips, or shoulders, 66 formed in the interior wall 60 of the gauge ring 40 that surrounds its bore 62. The stop 20 of the exemplary mandrel 10*b* includes one or more exterior protrusions, or shoulders, 22 extending from, or provided in or on, its outer surface 18. If desired, the forward end 54 of the exemplary gauge ring 40 may also, or instead, at least partially abut or shoulder up against one or more lips, or edges, 23 of the mandrel 10*b*. Thus, the movement of the illustrated gauge ring 40 over the mandrel 10*b* (in one direction) stops when its interior shoulder 66 and/or forward end 58 at least partially abut the shoulder(s) 22 and/or lip(s) 23 of the mandrel 10*b*, respectively, defining an operating position of the gauge ring 40.

Still referring to FIGS. 4 & 8, the illustrated gauge ring 40 may be secured in one or more operating positions relative to the mandrel 10*b* in any suitable manner (e.g. similarly as described above for the tandem spacer 8*a*). For example, the gauge ring 40 may be held in its operating position by one or more adjacent tools 27 on the tool string 26. In this embodiment, after the gauge ring 40 is positioned over or relative to the mandrel 10*b*, the adjacent tool 27 at the rear end 78 of the spacer 8*b* is engaged with the mandrel 10*b*. When that tool 27 is fully, properly engaged with the illustrated mandrel 10*b*, it will at least partially abut, or shoulder up, against the gauge ring 40 (e.g. at one or more lips, or edges, 70), ensuring the anchor(s) 64 of the gauge ring 40 properly engage the stop(s) 20 of the mandrel 10*b* and retaining the gauge ring 40 in at least one operating position. In the present embodiment, the proper threadable engagement of the forward end of that tool 27 (e.g. the second perforating gun 30*b*) to the rear end 78 of the mandrel 10*b* should ensure the shoulder(s) 66 of the gauge ring 40 at least partially abut the shoulder(s) 22 of the mandrel 10*b* and, if desired, the forward end 54 of the gauge ring 40 at least partially abuts the edge(s) 23 of the mandrel 10*b*, retaining the gauge ring 40 in an operating position. However, any other technique and components may be used to secure the gauge ring 40 in its operating position.

Also similarly as described above for the exemplary tandem spacer 8*a*, the end spacer 8*b* may be designed so that when the adjacent tool 27 at its rear end 14 is fully, properly engaged with the mandrel 10*b*, it will only abut, or shoulder up, against the rear end 58 of the gauge ring 40 (and not the mandrel 10*b*). Thus, in at least some embodiments, the end spacer 8*b* can be designed to provide for positive confirmation of proper connection of the adjacent tool 27 to the mandrel 10*b*. For example, the proper application of torque for threadably connecting the second perforating gun 30*b* (e.g. carrier 31) to the rear end 78 of the exemplary mandrel 10*b* is achieved when the gun 30*b* abuts the gauge ring 40 and/or the gauge ring 40 is fully, rigidly, sandwiched between the gun 30*b* and the exterior shoulder 22 (and/or edge 23) of the mandrel 10*b*.

However, any other techniques and components may be used to position each exemplary gauge ring 40 over, or relative to, its associated mandrel 10, or otherwise couple them together, such as suggested above.

Referring back to FIGS. 5-8, in another independent aspect of the present disclosure, the exemplary mandrel 10 and/or gauge ring 40 may include one or more (e.g. non-threaded) rotational, or torsional, locks 90 to prevent rotation of either of them relative to the other after the gauge ring 40 is secured to the mandrel 10, allow their concurrent rotation, allow torque to be transmitted from or through the gauge ring 40 to the mandrel 10, for any other purpose(s) or a combination thereof. When torque or rotational forces are applied to the exemplary gauge ring 40, for example, torque will be transmitted to the mandrel 10. Moreover, only the exemplary gauge ring 40 (not the mandrel 10) will need to be gripped (e.g. with a pipe wrench, other tool or gripper) during threadable or other connection/disconnection of the spacer 8 with one or more adjacent tools 27. Eliminating the need to grip the exemplary mandrel 10 during connection/disconnection with other tools 27 can, for example, allow the mandrel 10, and thus the spacer 8, to be constructed with a compact, efficient size (e.g. minimal length), saving valuable space on the tool string 26 and avoiding other negative consequences from a longer mandrel 10 and spacer 8.

When included, the rotational lock(s) 90 may have any suitable form, configuration and operation. For example, the rotational lock 90 may be non-threaded and more efficient than a threaded connection. In the present embodiments, the rotational lock 90 includes one or more pairs of corresponding engageable flats 94, 96 provided on the mandrel 10 and gauge ring 40, respectively. As used herein, the terms "flat" and variations thereof mean and refer to a portion of the referenced component that includes at least one surface having a different shape than one or more adjacent surfaces of that component. In some instances, such as when the outer surface 18 of the exemplary mandrel 10 is cylindrical and the bore 62 of the gauge ring 40 is circular, the respective flats 94, 96 may be planar.

In the present embodiments, each mandrel 10 and gauge ring 40 include two pairs of respective corresponding at least substantially planar flats 94, 96 that align with, or engage (e.g. abut) one another when the gauge ring 40 is seated in one or more operating positions. During use of the illustrated spacers 8, the flats 94, 96 prevent rotation of either component relative to the other and allow their concurrent rotation. However, the mandrel 10 and gauge ring 40 (or other components) may instead have only one or more than two (e.g. 3, 4, 5, etc.) pairs corresponding flats 94, 96 of any desired shape, configuration, operation and location, and/or any other type and quantity of rotational lock(s) 90 (e.g. gear mechanisms) may be used. Moreover, some embodiments may not include any rotational locks 90 and, if desired, allow at least some desired relative rotation between the gauge ring 40 and associated mandrel 10.

In accordance with various distinct independent aspects of the present disclosure, embodiments of methods of manufacture, assembly and use of spacers 8 are disclosed herein and apparent from this specification and the appended drawings.

Preferred embodiments of the present disclosure thus offer advantages over the prior art and are well adapted to carry out one or more of the objects of this disclosure. However, the present invention does not require each of the components and acts described above and is in no way limited to the above-described embodiments and methods of operation. Any one or more of the above components, features, aspects, capabilities and processes may be employed in any suitable configuration without inclusion of other such components, capabilities, aspects, features and processes. Thus, embodiments of the present disclosure may have any one or more of the features described or shown in this patent. Moreover, the present invention includes additional features, capabilities, functions, methods, uses and applications that have not been specifically addressed herein but are, or will become, apparent from the description herein, the appended drawings and claims.

The methods that may be described above, claimed herein or are apparent from this patent and any other methods which may fall within the scope of any appended claims can be performed in any desired suitable order and are not necessarily limited to any sequence described herein or as may be listed in any appended claims. Further, the methods of various embodiments of the present disclosure may include additional acts beyond those mentioned herein and do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or manufacture, assembly or use, are possible, contemplated by the patentee hereof, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative, and the scope of the disclosure and any appended claims should not be limited to the embodiments described or shown herein.

The invention claimed is:

1. A spacer tool useful for increasing the outer diameter of a tool string at a desired location in the tool string, the tool string including at least one other tool, each tool in the tool string having its own maximum outer diameter, the spacer tool comprising:

a mandrel releasably engageable with at least one other tool of the tool string; and a gauge ring having upper and lower ends, an interior circumferential shoulder disposed between the upper and lower ends, a bore having a first inner diameter extending from the upper end to the shoulder and a second inner diameter extending from the shoulder to the lowered, the second inner diameter differing from the first inner diameter, the gauge ring being distinct from and releasably, non-threadably engageable with the mandrel and at least partially movable over at least part of the mandrel into at least one operating position and extending radially outwardly therefrom to provide the maximum outer diameter of the spacer tool, whereby the maximum outer diameter of the spacer tool is greater than the maximum outer diameter of the at least one other tool in the tool string to increase the outer diameter of the tool string at that location, whereby threadable engagement of an outer body of a perforating gun to the mandrel prevents the gauge ring from separating from the mandrel.

2. The spacer tool of claim 1 wherein the gauge ring is comprised of a single piece that is slidably engageable with the mandrel, further wherein the gauge ring and mandrel are not directly coupled together with threads or any other form of coupling mechanism extending between and coupling the gauge ring directly to the mandrel.

3. The spacer tool of claim 1 wherein the gauge ring is secured to the mandrel only by a first adjacent tool in the tool string.

4. The spacer tool of claim 3 wherein the first adjacent tool is threadably engageable with the mandrel, wherein the threaded engagement of only the first adjacent tool to the mandrel secures the gauge ring to the mandrel.

5. The spacer tool of claim 3 wherein the mandrel includes at least one shoulder extending outwardly therefrom, whereby the gauge ring is in the at least one operating position when the gauge ring is sandwiched between the first adjacent tool and the at least one shoulder of the mandrel, the at least one operating position of the gauge ring being required at least during deployment of the tool string into a borehole and use of the first adjacent tool for its intended purpose therein.

6. The spacer tool of claim 5 wherein the first adjacent tool is threadably engageable with the mandrel and the proper amount of torque to threadably engage the first adjacent tool and the mandrel is applied when the gauge ring abuts and is sandwiched between the first adjacent tool and the at least one shoulder of the mandrel.

7. The spacer tool of claim 1 wherein the mandrel has an outer surface and at least a first shoulder extending outwardly therefrom, whereby the gauge ring is in at least one operating position when the interior circumferential shoulder thereof abuts at least the first shoulder of the mandrel, the at least one operating position of the gauge ring being required at least during deployment of the tool string into a borehole and use of the first adjacent tool for its intended purpose therein.

8. The spacer tool of claim 1 further including at least one rotational lock formed or extending between the gauge ring and mandrel at least during deployment of the tool string in a borehole and use of the first adjacent tool for its intended purpose therein.

9. The spacer tool of claim 8 wherein when the gauge ring is rotationally locked to the mandrel, the gauge ring can be gripped to allow threadable engagement and disengagement of the mandrel with the at least one adjacent tool without separately gripping the mandrel with any gripping tools.

10. The spacer tool of claim 1 wherein the gauge ring has an at least partially cylindrically-shaped bore surrounded at least partially by a wall and at least one flat provided in or on the wall and the mandrel has an at least partially cylindrically-shaped outer surface and at least one flat provided in or on the outer surface, further wherein at least one flat of the wall of the bore of the gauge ring aligns over at least one flat of the outer surface of the mandrel at least during deployment of the tool string in a borehole and use of the first adjacent tool for its intended purpose(s) therein.

11. The spacer tool of claim 1 wherein the tool string is deployable into a borehole and has a forward end that is insertable into the borehole first, whereby the mandrel is releasably engageable with the tool located at the forward end of the tool string so that the spacer tool becomes the forwardmost tool in the tool string and serves as an end spacer.

12. The spacer tool of claim 1 wherein the mandrel is releasably engageable with and between two other tools in the tool string so that the spacer tool serves as a tandem spacer.

13. A spacer tool useful for increasing the outer diameter of a perforating gun string having at least a first perforating gun and being deployable in an underground borehole, the spacer tool and first perforating gun each having a respective maximum outer diameter, the spacer tool comprising:

a mandrel threadably engageable with the first perforating gun, the mandrel having an at least partially cylindrically-shaped outer surface and at least one flat provided in or on the outer surface and facing radially outwardly; and a gauge ring distinct from and releasably, non-threadably engageable with the mandrel and, when engaged therewith, extends radially outwardly therefrom to provide the maximum outer diameter of the spacer tool that is greater than the maximum outer diameter of the first perforating gun, the gauge ring having a bore surrounded at least partially by a wall and at least one flat provided in or on the wall and facing radially inwardly, wherein at least one flat of the gauge ring aligns over at least one flat of the mandrel and alone rotationally locks the gauge ring and mandrel at least during deployment of the tool string into the borehole and operation of the first perforating gun therein, whereby the threadable engagement of the first perforating gun to the mandrel prevents the gauge ring from separating from the mandrel.

14. The spacer tool of claim 13 wherein the tool string is deployable into a borehole, further wherein the mandrel and gauge ring each include at least one outer surface, whereby at least one outer surface of the mandrel and/or the gauge ring includes at least one chamfer formed at a desired angle.

15. The spacer tool of claim 14 wherein the borehole has a borehole wall, further wherein the mandrel and/or gauge ring include at least one leading edge that is closest to borehole wall when the tool string is moving through the borehole, whereby at least one chamfer is provided at at least one leading edge of the mandrel and/or gauge ring.

16. The spacer tool of claim 14 wherein at least one chamfer is shaped and sized to help avoid hang-ups of the tool string when the tool string is moving through the borehole.

17. The spacer tool of claim 13 wherein the tool string is deployable into a borehole and the gauge ring includes at least one pump-down surface extending radially outwardly therefrom and into the borehole when the tool string is deployed in the borehole.

18. The spacer tool of claim 13 wherein the tool string is deployable into a borehole having a borehole wall, whereby the gauge ring is sized and shaped so that the maximum outer diameter of the spacer tool spaces the first perforating gun away from the borehole wall when the tool string is deployed in the borehole.

19. The spacer tool of claim 13 further including a plurality of interchangeable gauge rings each separately engageable with the mandrel, each gauge ring having at least one difference in size, shape, configuration or other characteristic than the other gauge rings, whereby the same mandrel can accommodate any among the plurality of gauge rings.

20. The spacer tool of claim 13 wherein the mandrel includes at least one protrusion extending outwardly therefrom and also includes first and second ends, further wherein the gauge ring is slidably engageable with the mandrel so that after the gauge ring is slidably engaged with the mandrel and the first perforating gun is thereafter threadably engaged with the mandrel, the gauge ring is prevented from sliding off the mandrel at the first end thereof by the at least one protrusion and at the second end thereof by the first perforating gun.

21. The spacer tool of claim 13 wherein the gauge ring is comprised of a single piece that is slidably engageable with the mandrel.

22. A method of increasing the outer diameter of a tool string at a desired location in the tool string with the use of a spacer tool, the spacer tool including a mandrel and a separate, distinct gauge ring having a length and a bore surrounded at least partially by an inner wall and being non-threadably engageable with the mandrel, the mandrel having first and second ends, the tool string including at least a first other tool adjacent to the spacer tool, each tool in the tool string having its own maximum outer diameter, the method comprising:

sliding the gauge ring at least partially over the mandrel from the first end toward the second end thereof so that a first portion of the gauge ring extends over a first portion of the mandrel and a second portion of the gauge ring extends over a second portion of the mandrel, the first portion of the gauge ring having an inner diameter greater than an inner diameter of the second portion thereof and the first portion of the mandrel having an outer diameter greater than an outer diameter of the second portion thereof;

an interior shoulder disposed between the first and second portions of the gauge ring abutting an exterior shoulder disposed between the first and second portions of the mandrel and stopping the movement of the gauge ring over the mandrel in the direction of the second end thereof;

at least one radially inwardly facing flat provided in or on the inner wall of gauge ring aligning over at least one radially outwardly facing flat provided in or on an outer surface of the mandrel and preventing relative rotation between the gauge ring and mandrel; and the gauge ring extending radially outwardly from the mandrel to provide the maximum outer diameter of the spacer tool, wherein the maximum outer diameter of the spacer tool is greater than the maximum outer diameter of the first adjacent tool on the tool string.

23. The method of claim 22 further including securing the first adjacent tool to the first end of the mandrel, the first adjacent tool preventing the gauge ring from sliding off the mandrel in the direction of the first end of the mandrel.

* * * * *